US005934837A

United States Patent [19]

Lee

[11] Patent Number: 5,934,837

[45] Date of Patent: Aug. 10, 1999

[54] MULTIPURPOSE, COMBINED, PRE-CASTING PILE ASSEMBLY

[76] Inventor: Chen-Fang Lee, No. 26-42, Liu An, Liu An Li, Chia-Li Chen, Tainan Hsien, Taiwan

[21] Appl. No.: 08/896,765

[22] Filed: Jul. 18, 1997

[51] Int. Cl.[6] ..... E02D 5/20

[52] U.S. Cl. ..... 405/250; 405/231; 405/257; 52/169.9; 52/281

[58] Field of Search ..... 405/250, 251, 405/252, 256, 257, 231, 232, 275; 52/169.9, 281, 282.1

[56] References Cited

U.S. PATENT DOCUMENTS

| | | | |
|---|---|---|---|
| 942,653 | 12/1909 | Louque | 405/256 |
| 1,178,531 | 4/1916 | McLean | 405/250 |
| 1,198,459 | 9/1916 | Langworth | 405/275 |
| 1,665,462 | 4/1928 | Howard | 405/275 |
| 2,351,288 | 6/1944 | Riches | 405/252 |
| 2,507,259 | 5/1950 | Levasseur | 405/252 |
| 3,472,031 | 10/1969 | Kelso | 52/169.9 X |
| 4,239,419 | 12/1980 | Gillen, Jr. | 405/232 |
| 4,327,703 | 5/1982 | Destree | 405/256 X |
| 4,797,037 | 1/1989 | Hong | 405/251 X |
| 5,746,036 | 5/1998 | Angelette | 405/252 X |

*Primary Examiner*—David J. Bagnell
*Assistant Examiner*—Jong-Suk Lee
*Attorney, Agent, or Firm*—Varndell Legal Group

[57] ABSTRACT

A multipurpose, combined and pre-casting pile assembly, comprises an anchoring and extending piles configured in a shape of the Star of David which includes three V-shaped longer extensions and three V-shaped shorter extensions alternatively arranged. The center of the anchoring and extending piles have a hexagonal passage and a plurality of holes are arranged around the hexagonal passage. One end of the extending pile unit can be fixedly attached to the anchoring pile unit and another end of the extending pile can be connected with another extending pile unit by the use of connecting rods received in the holes arranged about the hexagonal passage. When two anchoring and extending pile units are spaced from each and the V-shaped longer extensions are aligned with each other, a continuous slab having a V-shaped groove at both sides can be disposed between two adjacent anchoring and extending piles units such that an embanking wall or water dam can be configured. A plurality of anchoring and extending piles units can be arranged in a honeycomb array for a heavy duty application such as the embanking wall on the water resource area.

2 Claims, 5 Drawing Sheets

MULTIPURPOSE, COMBINED, PRE-CASTING PILE ASSEMBLY

FIELD OF THE INVENTION

The present invention relates to a pile assembly, more particularly, to a multipurpose, combined and pre-casting pile configuration which can be readily adapted to meet different requirements at site.

DESCRIPTION OF PRIOR ART

In order to preserve the soil or slope within the water resource area, an erected dam or embanking wall is used to prevent a landfall. In building the embanking wall, the basement shall be firstly evacuated firstly, then the reinforced ribs cage and concrete are cast to build a continuous embanking wall. However, building a continuous embanking wall costs a great deal of labor hours. Furthermore, a lot of mud will be also generated during the construction. This embanking wall is not durable and has only a single purpose. It is not a cost-effective way. On the other hand, many a construction, such as evacuating a river, conducting an improved work on the sea floor and building an artificial land, are needed with an embanking wall to block the water and evacuating the sand. However, the final construction quality are difficult to control and a second pollution to the environment from the mud and sand will be experienced.

SUMMARY OF THE INVENTION

It is the objective of this invention to provide a multipurpose, combined and pre-casting pile configuration which is configured by an archoring pile unit, an extending pile unit and a continuous slab. The anchoring pile unit is provided with a plurality of pre-casting openings in the peripheral and central positions. The extending unit is also provided with a plurality of pre-casting openings which are aligned with the pre-casting openings of the anchoring pile unit. A plurality of connecting rods are inserted and fixedly retained within those aligned openings such that the anchoring pile unit can be fixedly connected with the extending pile unit. By this arrangement, a certain length of the pile can be readily assembled to form an extended pile units assembly. Furthermore, a plurality pile assemblies can be arranged into a hexagonal array or other shape and each of the pile assemblies is interconnected with another by a connecting slab. By this arrangement, a honeycomb piles configuration can be also configured. By the suggestion of the present invention, a variety of configuration can be configured, such as a tube, pile and a groove. This can be widely used on the slope on the water resource area to prevent a landfall thereof. On the other hand, when the pile units are configured into a tube, post or groove, a plurality of liquid material can be stored therein or it can be widely applied in the construction of evacuating the river or building a new artificial land at seashore.

DETAILED DESCRIPTION OF PREFERRED EMBODIMENT

The present invention relates to a multipurpose, combined and pre-casting pile configuration which can be readily adapted to meet different requirements at site. For example, it can be used on the embanking wall to prevent a landfall in a water resource area and/or the area where the preservation of soil is very important. On the other hand, the pile assembly can be readily applied to the evacuating of river, building an artificial land at seashore. The pile assembly can be used for containing liquid. This novel pile assembly can provide a construction in a more fast and save manner and the overall cost can be largely reduced.

It is the objective of this invention to provide a multipurpose, combined and pre-casting pile configuration which is configured by an anchoring pile unit, an extending pile unit and a continuous slab. The anchoring pile unit is provided with a plurality of pre-casting openings in the peripheral and central positions. The extending unit is also provided with a plurality of pre-casting openings which are aligned with the pre-casting openings of the anchoring pile unit. A plurality of connecting rods are inserted and fixedly retained within those aligned openings such that the anchoring pile unit can be fixedly connected with the extending pile unit. By this arrangement, a certain length of the pile can be readily assembled to form an extended pile units assembly. Furthermore, a plurality pile assemblies can be arranged into a hexagonal array or other shape and each of the pile assemblies is interconnected with another by a connecting slab. By this arrangement, a honeycomb piles configuration can be also configured. By the suggestion of the present invention, a variety of configuration can be configured, such as a tube, pile and a groove. This can be widely used on the slope on the water resource area to prevent a landfall thereof. On the other hand, when the pile units are configured into a tube, post or groove, a plurality of liquid material can be stored therein.

The features, construction and function can be more understood by referring to the following description.

Figure 1:
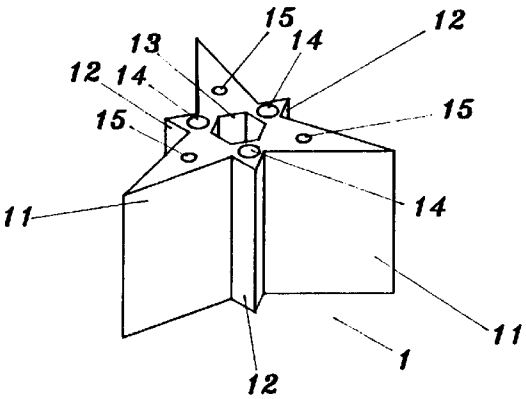
FIG. 1 is a perspective view of the anchoring pile unit.
Figure 7:
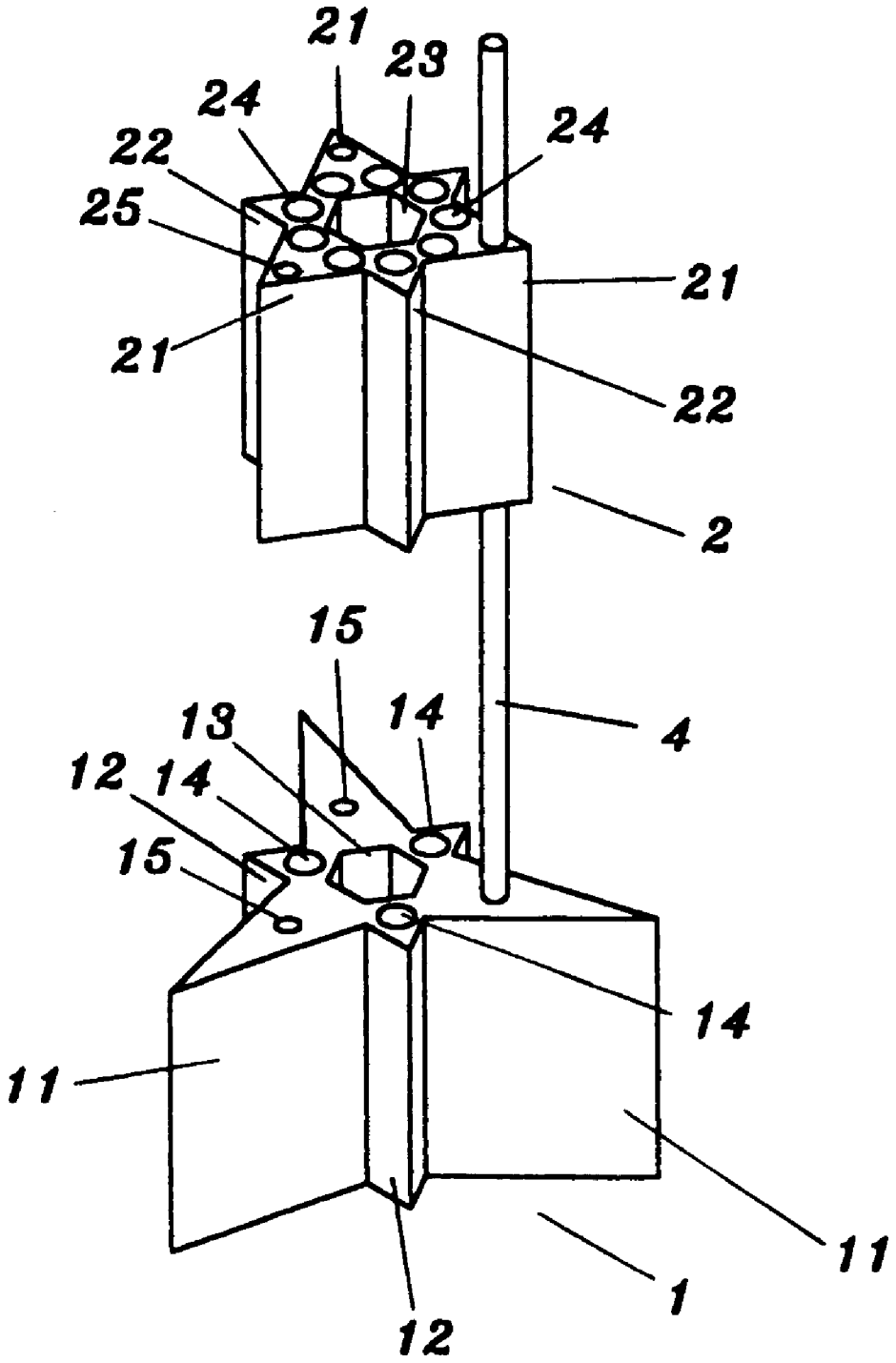
FIG. 7 shows an anchoring pile unit connected by a connecting post to an extending pile unit.

Referring to FIG. 1 which is a perspective view of the anchoring pile unit having a shape of David star (the star of David). The anchoring pile unit 1 is provided with a three V-shaped longer extensions 11 and three V-shaped shorter extensions 12 which are alternatively arranged. The middle portion of the anchoring pile unit 1 is provided with a passage having a hexagonal cross section. Each of the V-shaped longer extension 11 is provided with a hole 15 and each of the V-shaped shorter extension 12 is provided also with a hole 14. The anchoring pile unit 1 can be fixedly anchored into the ground by the hexagonal passage 13 and the hole 14. A connecting post 4 can be used to connect an extending pile unit 2 onto anchoring pile unit 1 through the hole 15. See, for example, FIG. 7 where the connecting post 4 connects an extending pile unit 2 onto the anchoring pile unit 1 by insertion into the hole 15 of the anchoring pile unit 1 and hole 25 of the extending pile unit 2.

Figure 2:
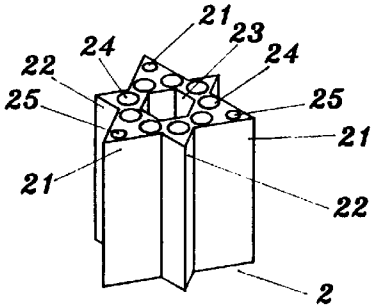
FIG. 2 is a perspective view of a pre-casting pile unit.

Referring to FIG. 2, the extending pile unit 2 has been also formed with a shape of David star and which has three V-shaped longer extensions 21 and three V-shaped shorter extensions 22 which are alternatively arranged from each other. The extending pile unit 2 is also provided with a hexagonal passage in the middle portion. The extending pile unit 2 is further provided with a plurality of holes 24 which are arranged around the hexagonal passage 23. Each of the V-shaped longer extensions 21 is also provided with a hole 25 by which the connecting rod 4 can be inserted and retained thereof. Consequently, the extending pile unit 2 can be fixedly connected to the anchoring pile unit 1.

Figure 3:
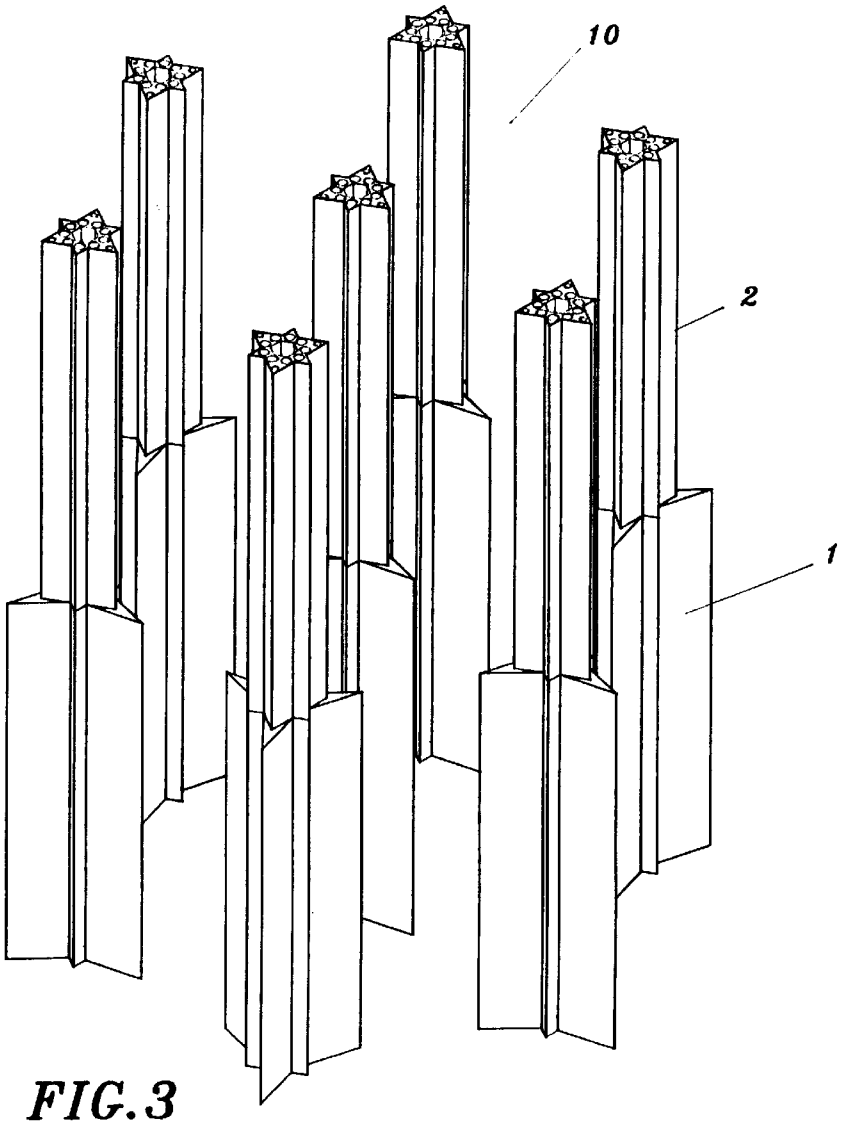
FIG. 3 is a perspective view of a pile assembled from the pile units of FIGS. 1 and 2.
Figure 4:
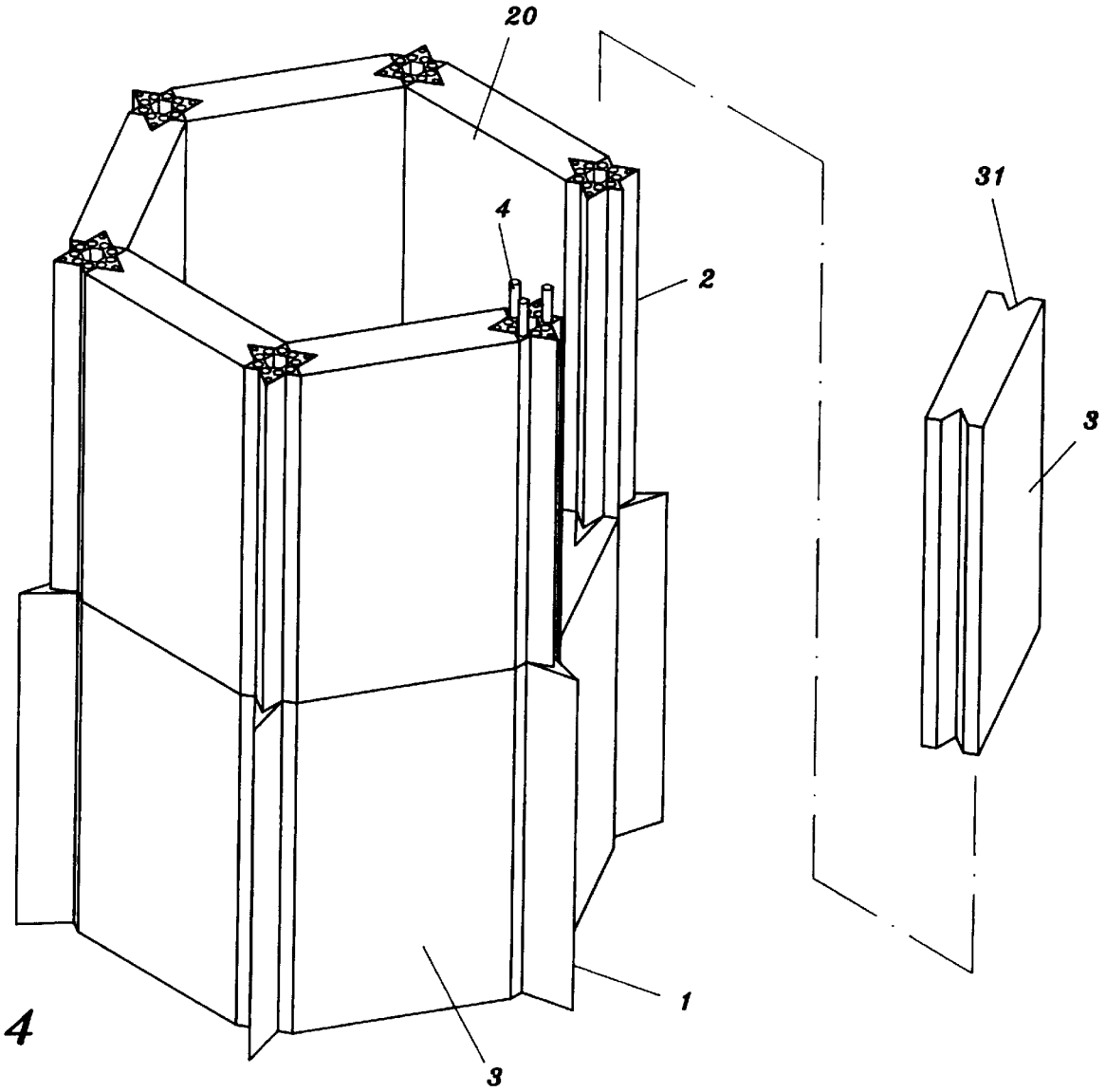
FIG. 4 is a perspective view of an assembled pile.
Figure 5:
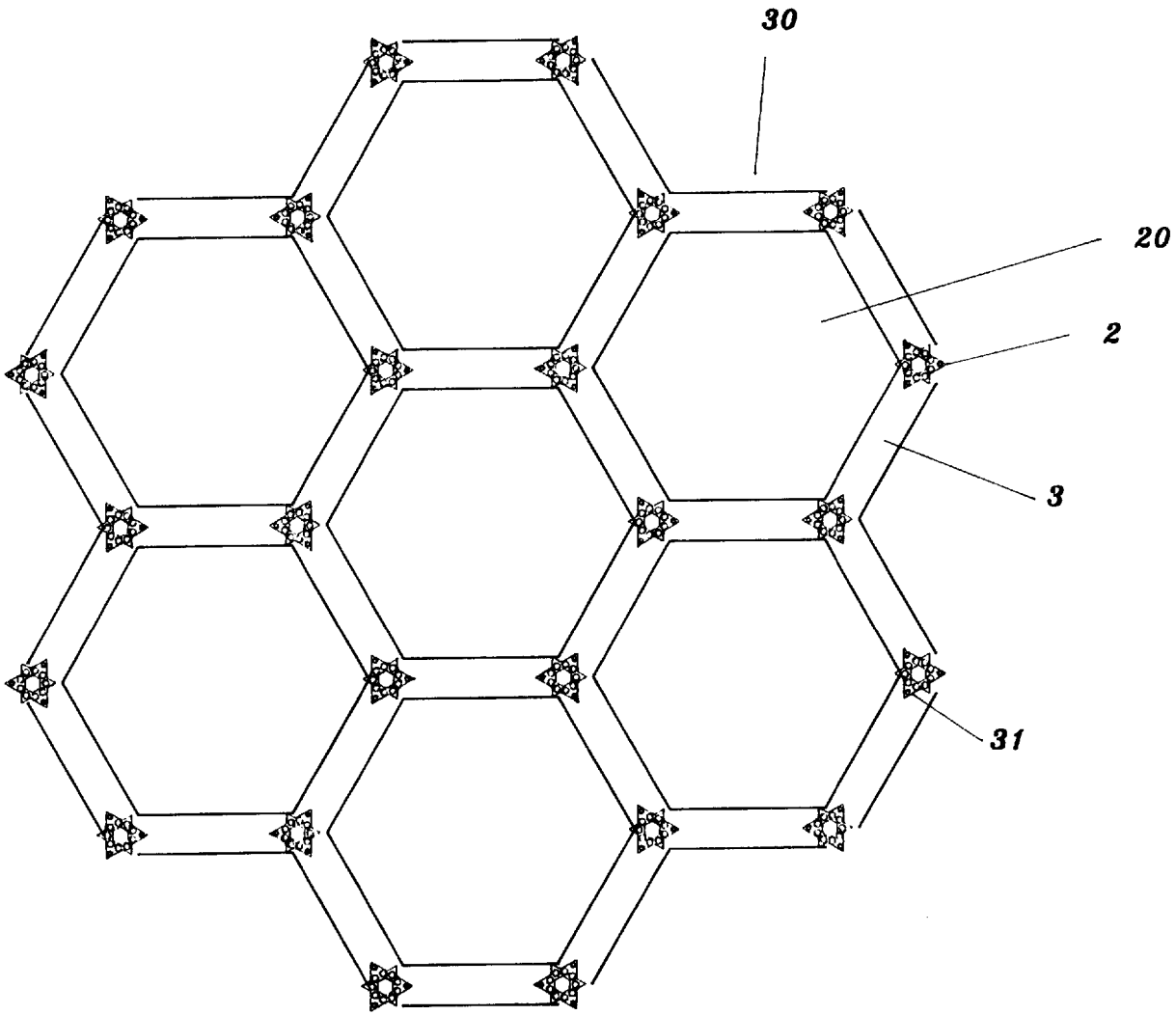
FIG. 5 is a schematic illustration of the pile after assembled.
Figure 6:
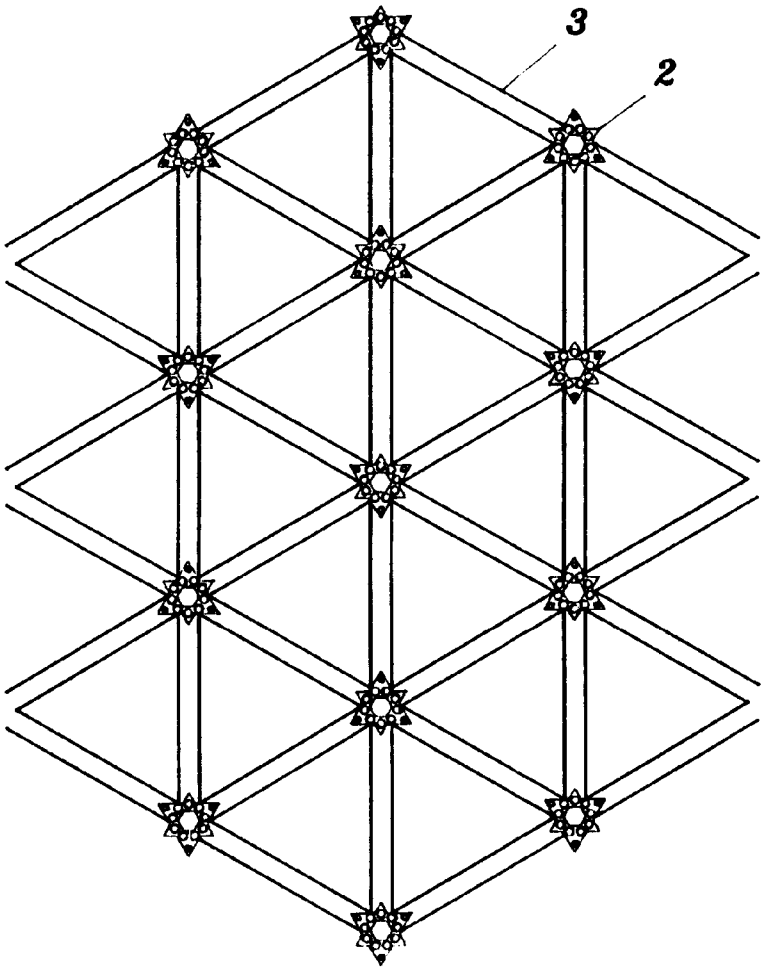
FIG. 6 is another application of the piles made according to the present invention.

Referring to FIGS. 3 and 4, in attaching the extending pile unit 2 onto the anchoring pile unit 1, three connecting rods 4 are used to connect the extending pile unit 2 onto the anchoring pile unit 1. As a result, a pile assembly 10 can be configured. In the illustrated embodiment, six pile assemblies 10 are arranged in a hexagonal arrangement and each of the pile assembly 10 is aligned with the other pile assembly 10 with the V-shaped longer extensions 11, 21. Then a continuous slab 3 having a V-shaped groove 31 at both sides can be readily disposed between two opposed arranged V-shaped longer extensions 11, 21. As a result, an enclosed tank 20 can be readily formed. Consequently, a hexagonal tank 20 can be readily configured by those six pile assemblies 10 which are equally spaced from each other. When more and more pile assemblies 10 are used and extended in the same way, a honeycomb arrangement 30 can be also formed, as shown in FIGS. 5 and 6. By this arrangement, a continuous honeycomb wall 30 or a single pile assembly 10 or single tank form by six pile assemblies 10 can be readily formed. This configuration can be readily used as an embanking wall, water dam or even for storing liquid or other material.

By the provision of the multipurpose, combined and pre-casting pile assembly of the present invention, a special configuration can be readily configured by the triangular mechanics. The overall configuration or pile assembly or pile assemblies array can be readily and efficiently established in a very short time. Once the array is established, it can be immediately used as an embarking wall, water dam or even used for storing water. The labor hours and cost can be largely reduced.

From the forgoing description, it can be readily appreciated that by the compact and simplified configuration of the present invention, the conventional difficulty met by the civil and hydraulic construction can be readily performed. By the provision of the present invention, even a difficult work which is impossible for the conventional method to complete, but with the provision of the present invention, it can be readily completed. While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A continuous embanking wall, comprising at least two anchoring pile units which are spaced apart from each other and being configured with a shape of David star which includes three V-shaped longer extensions and three V-shaped shorter extensions which are alternatively arranged, each of said anchoring pile units being provided with a hexagonal passage, each of said V-shaped longer and shorter extensions being provided with a hole for receiving and retaining a connecting rod therein, wherein said anchoring pile units are arranged such that said V-shaped longer extensions are aligned with each other;

at least two extending pile units and each being fixedly attached to one of said anchoring pile unit and being configured with a shape of David star which includes three V-shaped longer extensions and three V-shaped shorter extensions which are alternatively arranged, a center of said extending pile unit being provided with a hexagonal passage and a plurality of holes being arranged around said hexagonal passage, each of said V-shaped shorter extensions being provided with a connecting hole and a connecting rod being received and retained therein, one end of said extending pile unit being fixedly attached to said anchoring pile unit and the other end of said extending pile unit being connected with another extending pile unit, wherein said extending pile units are arranged such that said V-shaped longer extensions are aligned with each other; and a continuous slab which has V-shaped grooves at both ends being disposed between said anchoring pile units which are spaced from each other.

2. The continuous embanking wall as recited in claim 1, wherein a plurality of said anchoring pile units and said extending pile units can be arranged in a honeycomb array or cellular arrangement.

* * * * *